US008397435B2

(12) United States Patent
Iannelli

(10) Patent No.: US 8,397,435 B2
(45) **Date of Patent: *Mar. 19, 2013**

(54) ROOF GUTTER COVER SECTION WITH WATER DRAINING UPPER SURFACE

(76) Inventor: Anthony M. Iannelli, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/091,580

(22) Filed: Apr. 21, 2011

(65) Prior Publication Data

US 2011/0225898 A1 Sep. 22, 2011

Related U.S. Application Data

(63) Continuation of application No. 12/282,228, filed as application No. PCT/US2006/010288 on Mar. 22, 2006, now Pat. No. 7,950,187, which is a continuation-in-part of application No. 10/800,563, filed on Mar. 15, 2004, now abandoned.

(51) Int. Cl.
*E04D 13/076* (2006.01)
*E04D 13/064* (2006.01)

(52) U.S. Cl. ..... 52/11; 52/15; 52/16; 52/13; 248/48.1; 210/162

(58) Field of Classification Search ..... 52/11–16; 248/48.1, 48.2; 210/162, 163, 469, 473–474, 210/477

See application file for complete search history.

(56) References Cited

U.S. PATENT DOCUMENTS

| | | | |
|---|---|---|---|
| 109,067 | A | 11/1870 | Smith, Jr. |
| 397,534 | A | 2/1889 | Carroll |
| 546,042 | A | 9/1895 | Van Horn |
| 603,611 | A | 5/1898 | Nye |
| 836,012 | A | 11/1906 | Cassen |
| 870,165 | A | 11/1907 | Hagler et al. |
| 891,405 | A | 6/1908 | Cassens |
| 1,101,047 | A | 6/1914 | Yates |
| 1,602,261 | A | 10/1926 | Hill |
| 2,144,663 | A | 1/1939 | Petersen |
| 2,247,024 | A | 6/1941 | Hurley |
| 2,271,081 | A | 1/1942 | Layton |
| 2,334,779 | A | 11/1943 | Luff |
| 2,348,827 | A | 5/1944 | Lambert |

(Continued)

FOREIGN PATENT DOCUMENTS

| | | |
|---|---|---|
| AT | 327651 | 4/1975 |
| AT | 77270 | 7/1992 |

(Continued)

OTHER PUBLICATIONS

U.S. Appl. No. 10/800,563, Filed Mar. 15, 2004, Iannelli.

(Continued)

*Primary Examiner* — Jeanette E. Chapman
(74) *Attorney, Agent, or Firm* — Frost Brown Todd LLC

(57) ABSTRACT

A top portion (12) of the gutter section (10) is formed with a pair of longitudinally extending, relatively spaced apart ridges (20) and with a plurality of openings (22) disposed on, infront of, in between and behind the ridges (20) for draining rainwater into the gutter (10). A front wall (13) extends downwardly from the top portion (12) and a ledge (14) extends generally horizontally form a lower portion 13B of the front wall (13). The distance D between an upper edge (17) of the front wall (13) and the horizontal ledge (14) is relatively short to improve the versatility and appearance of the cover section 10. The aluminum alloy from which the cover section (10) is formed is relatively thin and the openings (22) in the on the cover section top portion (12) are large enough to facilitate drainage, yet small enough to keep debris from accumulating on the cover section (10).

18 Claims, 5 Drawing Sheets

U.S. PATENT DOCUMENTS

| | | | | |
|---|---|---|---|---|
| 2,431,012 | A | | 11/1947 | Alig |
| 2,537,243 | A | | 1/1951 | Swartz |
| 2,569,568 | A | | 10/1951 | Lipshaw |
| 2,636,458 | A | | 4/1953 | Harris |
| 2,669,950 | A | | 2/1954 | Bartholomew |
| 2,672,832 | A | | 3/1954 | Goetz |
| D181,753 | S | | 12/1957 | Scaulaud et al. |
| 2,847,949 | A | | 8/1958 | Poud |
| 2,873,700 | A | | 2/1959 | Heier |
| 2,988,226 | A | | 6/1961 | Campbell |
| 3,256,650 | A | | 6/1966 | Weckerly et al. |
| 3,296,749 | A | | 1/1967 | Cotter |
| 3,388,555 | A | | 6/1968 | Foster |
| 3,420,378 | A | | 1/1969 | Turner |
| 3,426,987 | A | | 2/1969 | Leslie |
| 3,507,396 | A | | 4/1970 | Horna |
| 3,612,453 | A | | 10/1971 | Zimmer |
| 3,660,955 | A | | 5/1972 | Simon |
| 3,710,405 | A | | 1/1973 | Watts |
| 3,752,428 | A | | 8/1973 | Trostle et al. |
| 3,892,378 | A | | 7/1975 | Lane |
| 3,950,951 | A | | 4/1976 | Zukauskas |
| 4,198,043 | A | | 4/1980 | Timbes et al. |
| 4,241,548 | A | | 12/1980 | Rowe |
| 4,254,595 | A | | 3/1981 | Crosslen |
| 4,307,976 | A | | 12/1981 | Butler |
| 4,404,775 | A | | 9/1983 | Demartini |
| 4,411,110 | A | | 10/1983 | Carey |
| 4,435,925 | A | | 3/1984 | Jefferys |
| 4,455,791 | A | | 6/1984 | Elko et al. |
| 4,467,579 | A | | 8/1984 | Weinar |
| 4,497,146 | A | | 2/1985 | Demartini |
| 4,622,785 | A | | 11/1986 | Miller |
| 4,750,300 | A | | 6/1988 | Winger, Jr. |
| 4,796,390 | A | | 1/1989 | Demartini |
| 4,848,044 | A | | 7/1989 | LaRoche et al. |
| 4,937,986 | A | | 7/1990 | Way, Sr. et al. |
| 4,941,299 | A | | 7/1990 | Sweers |
| 4,944,050 | A | | 7/1990 | Shames et al. |
| D310,259 | S | | 8/1990 | Hitchins |
| 4,949,514 | A | | 8/1990 | Weller |
| 5,010,696 | A | | 4/1991 | Knittel |
| 5,029,794 | A | | 7/1991 | Wolfe |
| 5,072,551 | A | | 12/1991 | Manoogian, Jr. |
| 5,099,620 | A | | 3/1992 | Carey |
| 5,106,046 | A | | 4/1992 | Rowles et al. |
| 5,181,350 | A | | 1/1993 | Meckstroth |
| 5,216,852 | A | | 6/1993 | Bemis et al. |
| 5,271,191 | A | | 12/1993 | Vahamaki |
| 5,271,192 | A | | 12/1993 | Nothum, Sr. et al. |
| 5,339,575 | A | | 8/1994 | Kuhns |
| 5,375,379 | A | | 12/1994 | Meckstroth |
| 5,406,755 | A | | 4/1995 | Serano |
| 5,457,916 | A | | 10/1995 | Tenute |
| 5,536,113 | A | | 7/1996 | McGregor |
| 5,555,680 | A | | 9/1996 | Sweers |
| 5,557,891 | A | | 9/1996 | Albracht |
| 5,588,261 | A | | 12/1996 | MacConochie |
| 5,605,020 | A | | 2/1997 | Chambers |
| 5,640,809 | A | * | 6/1997 | Iannelli ..... 52/12 |
| 5,640,810 | A | | 6/1997 | Pietersen |
| 5,660,001 | A | | 8/1997 | Albracht |
| 5,729,931 | A | | 3/1998 | Wade |
| 5,737,879 | A | | 4/1998 | Sweet |
| 5,802,777 | A | | 9/1998 | Sato et al. |
| 5,813,173 | A | | 9/1998 | Way, Sr. |
| 5,852,990 | A | | 12/1998 | Primdahl |
| 5,862,631 | A | | 1/1999 | Attaway et al. |
| 5,893,240 | A | | 4/1999 | Ealer, Sr. |
| 5,956,904 | A | | 9/1999 | Gentry |
| 5,960,591 | A | | 10/1999 | Schluter |
| 6,009,672 | A | | 1/2000 | Kuhns |
| 6,016,631 | A | * | 1/2000 | Lowrie, III ..... 52/12 |
| 6,047,502 | A | | 4/2000 | Kimmitt et al. |
| 6,067,755 | A | | 5/2000 | Maanum |
| 6,073,398 | A | | 6/2000 | Williams |
| 6,098,344 | A | | 8/2000 | Albracht |
| 6,098,345 | A | | 8/2000 | Demartini et al. |
| 6,134,843 | A | | 10/2000 | Tregear |
| 6,161,338 | A | | 12/2000 | Kuhns |
| 6,164,020 | A | | 12/2000 | Nitch |
| 6,202,357 | B1 | | 3/2001 | Spradlin |
| 6,254,039 | B1 | | 7/2001 | Zimmerman |
| 6,269,592 | B1 | | 8/2001 | Rutter |
| 6,314,685 | B1 | | 11/2001 | Sullivan |
| 6,349,506 | B1 | | 2/2002 | Pace et al. |
| 6,363,662 | B1 | | 4/2002 | Coates |
| 6,367,743 | B1 | | 4/2002 | Iannelli |
| 6,412,228 | B1 | | 7/2002 | Meckstroth |
| 6,412,229 | B2 | | 7/2002 | Kuhns |
| 6,427,388 | B1 | | 8/2002 | Brochu |
| 6,453,622 | B1 | | 9/2002 | Walters |
| 6,463,700 | B2 | | 10/2002 | Davis |
| 6,493,993 | B1 | | 12/2002 | Serano |
| 6,598,352 | B2 | | 7/2003 | Higginbotham |
| 6,672,012 | B2 | | 1/2004 | Bahroos et al. |
| 6,681,527 | B2 | | 1/2004 | Baker |
| 6,688,045 | B1 | | 2/2004 | Pilcher |
| 6,701,674 | B1 | | 3/2004 | Albracht |
| 6,732,477 | B1 | | 5/2004 | Richard |
| 6,735,907 | B2 | | 5/2004 | Stevens |
| 6,854,692 | B1 | | 2/2005 | Winkel |
| 6,877,281 | B1 | | 4/2005 | Gavin |
| 6,904,718 | B2 | | 6/2005 | Fox |
| 6,968,651 | B2 | | 11/2005 | Bergeron |
| 7,143,549 | B2 | | 12/2006 | Brochu |
| 7,950,187 | B2 | | 5/2011 | Iannelli |
| 2002/0124476 | A1 | | 9/2002 | Iannelli |
| 2003/0046876 | A1 | | 3/2003 | Higginbotham |
| 2003/0110712 | A1 | | 6/2003 | Brochu |
| 2003/0194269 | A1 | | 10/2003 | Garza |
| 2005/0005526 | A1 | | 1/2005 | Teed |
| 2005/0166465 | A1 | | 8/2005 | Banks et al. |
| 2005/0210758 | A1 | | 9/2005 | Iannelli |
| 2005/0235577 | A1 | | 10/2005 | Smith |
| 2006/0179723 | A1 | | 8/2006 | Robins |
| 2009/0139152 | A1 | | 6/2009 | Smith |
| 2009/0139180 | A1 | | 6/2009 | Kehs et al. |

FOREIGN PATENT DOCUMENTS

| | | |
|---|---|---|
| CA | 2 172 948 | 9/1996 |
| CA | 2 646 519 | 9/2007 |
| WO | WO 99/31332 | 6/1999 |
| WO | WO 2007/0108801 | 9/2007 |

OTHER PUBLICATIONS

U.S. Appl. No. 10/935,950, Filed Sep. 8, 2004, Iannelli.
U.S. Appl. No. 11/457,051, Filed Jul. 12, 2006, Iannelli.
U.S. Appl. No. 11/831,607, Filed Jul. 31, 2007, Iannelli.
U.S. Appl. No. 12/282,228, Filed Sep. 9, 2008, Iannelli.
Extended Search Report and Supplementary European Search Report dated Oct. 5, 2010 for Application No. EP06748529.
International Search Report dated Oct. 2, 2006 for Application No. PCT/US06/10288.
Written Opinion dated Oct. 2, 2006 for Application No. PCT/US06/010288.

* cited by examiner

ROOF GUTTER COVER SECTION WITH WATER DRAINING UPPER SURFACE

RELATED APPLICATION

This application is a continuation of, and claims priority to U.S. patent application Ser. No. 12/282,228 filed Sep. 9, 2008, now U.S. Pat. No. 7,950,187,which is a national stage entry of, and claims priority to, PCT/US06/10288 filed Mar. 22, 2006, which is a continuation in part of, and claims priority to, U.S. patent application Ser. No. 10/800,563 filed Mar. 15, 2004now abandoned.

TECHNICAL FIELD

The present invention relates to covers or shields adapted to be mounted over a roof gutter to keep out leaves and other debris, and more particularly to gutter covers that channel or drain the rainwater into the gutter principally through their upper surfaces.

BACKGROUND ART

In the past, typical gutter covers have been formed with a substantially imperforate upper surface or top portion and with a relatively deep, water-channeling trough located near the area where the cover is attached to the front lip of the gutter. This arrangement was believed to provide the most durability, leaf-shedding ability and pleasing appearance. However, the imperforate top, deep trough gutter cover was somewhat limited in its versatility. Likewise, the water-channeling trough tended to require a relatively elevated front wall that, in turn, occasionally resulted in difficulty mounting the rear portion of the gutter cover on the roof structure without changing the position of the gutter. As a result of these limitations, installing these conventional gutter covers could be relatively laborious or even impossible in the case of older structures such as half-round or box-style gutters. It is also believed that there is a need in the industry for a gutter cover that is less expensive to produce and install than the aforementioned conventional cover. Thus, the present inventor was faced with the problems of devising a more versatile and less expensive gutter cover than those currently marketed.

DISCLOSURE OF THE INVENTION

The present invention is a cover section for a roof gutter and is fashioned to extend longitudinally in overlying relation to a length of the gutter. The present cover section may comprise a top portion extending forwardly from a rear edge thereof, a front wall extending generally downwardly from the top portion, a ledge-extending generally horizontally from a lower section of the front wall, one or more longitudinally extending ridges formed in the top portion, and a plurality of apertures extending through the top portion and disposed on, in front of and behind the longitudinally extending ridge or ridges.

BEST MODE FOR CARRYING OUT THE INVENTION

Figure 1:
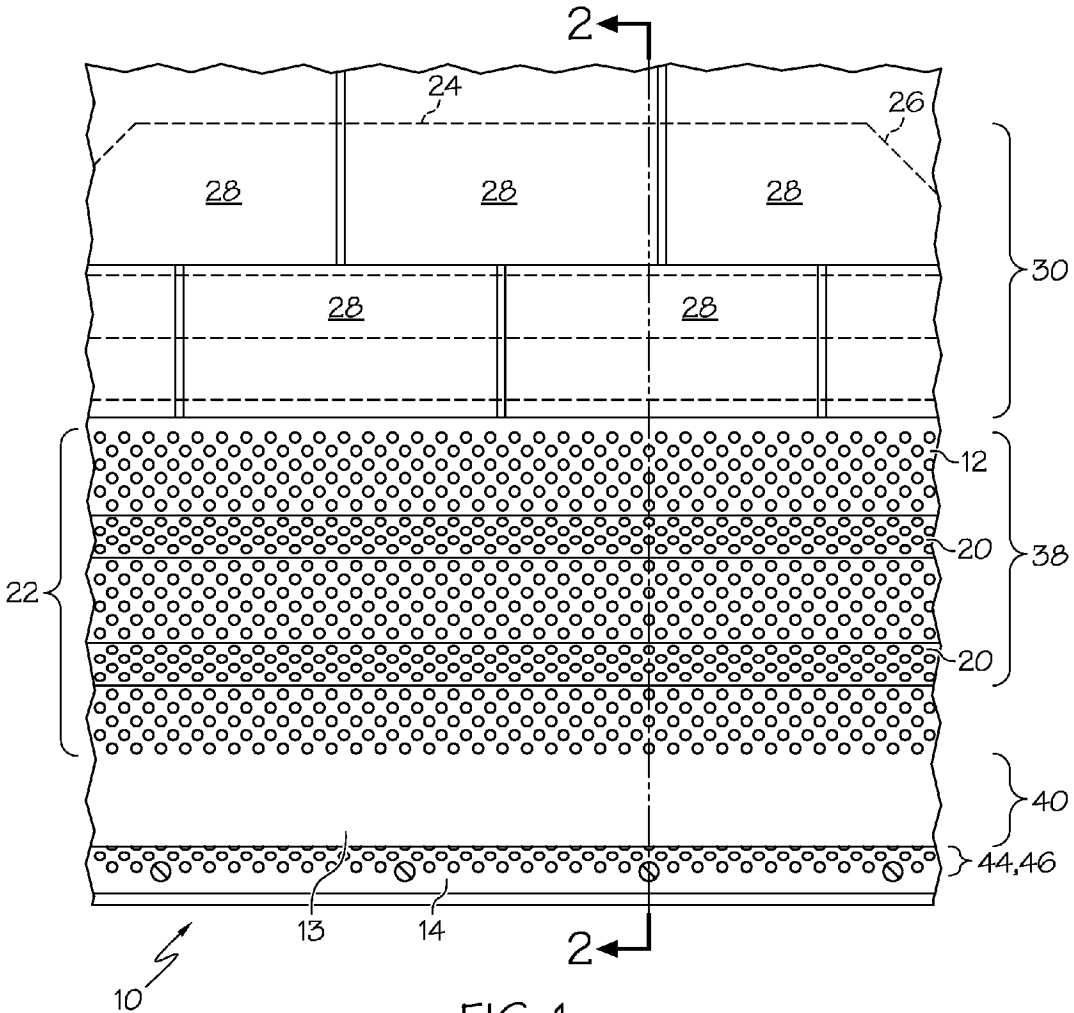
FIG. 1 is a fragmentary top plan view of a lower portion of a roof with a gutter and a gutter cover section according to the present invention mounted thereon.
Figure 2:
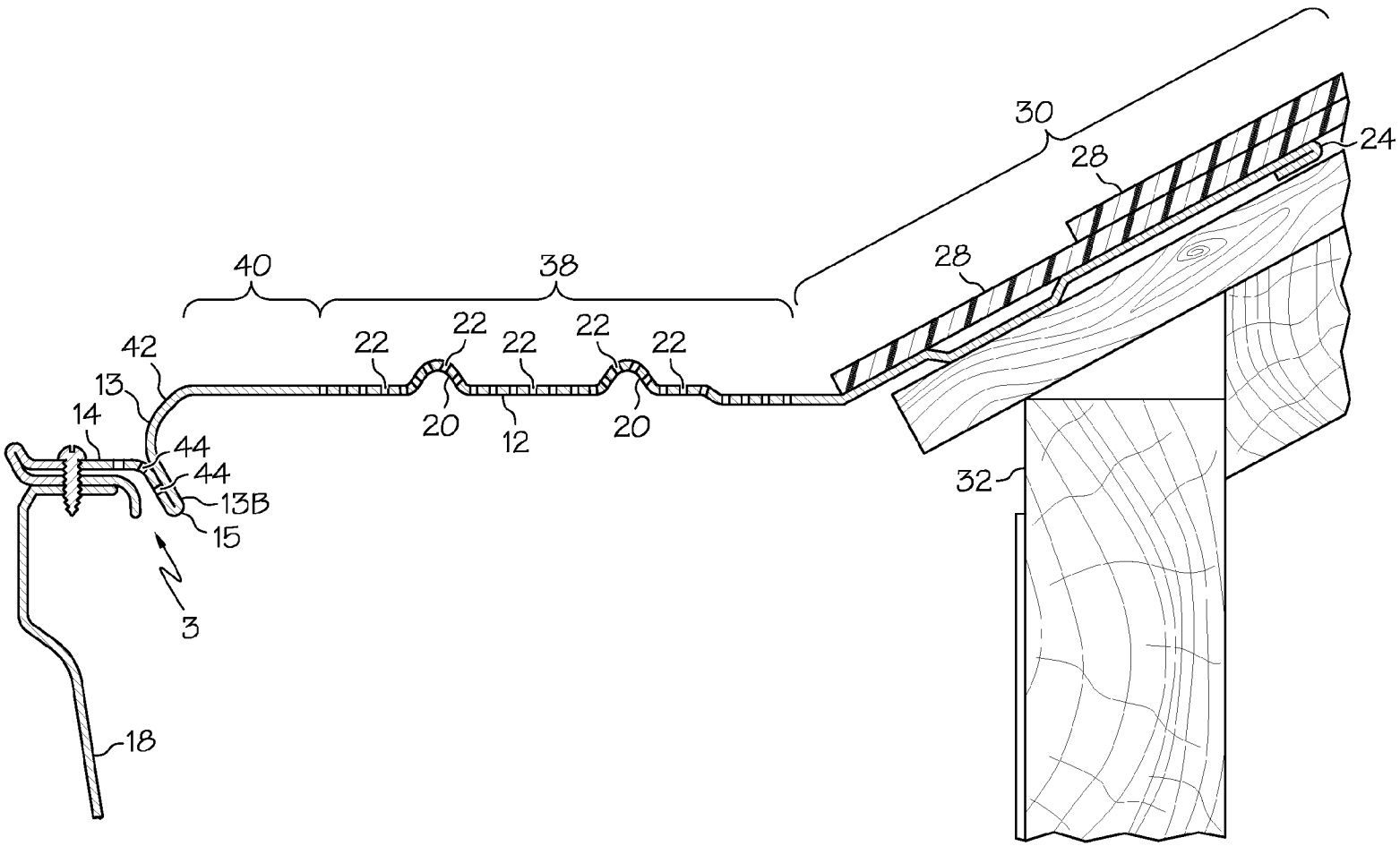
FIG. 2 is an enlarged sectional view taken along line 2-2 of FIG. 1 and particularly illustrates one of the preferred embodiments of the present gutter cover.

As indicated in FIGS. 1 and 2, the present invention is a cover section, generally designated 10, for a roof gutter 18 and is fashioned to extend longitudinally in overlying relation to a length of the gutter 18. The present gutter cover section 10 basically comprises a top portion 12 extending forwardly from a rear edge 24 of said cover section 10, a front wall 13 extending generally downwardly from the top portion 12, a ledge 14 extending generally horizontally from a lower section 13B of the front wall 13, at least one longitudinally extending ridge 20 formed in the top portion 12, and a plurality of apertures 22 extending through the top portion 12 and disposed on, in front of and behind the at least one longitudinally extending ridge 20.

As further illustrated in FIGS. 1 and 2, the present gutter cover section 10 is preferably integrally and unitarily formed from a single sheet of aluminum alloy that is within a thickness range of 0,041-0.081 cm. (0.016-0.032 in.) and within a length range of 109-155 cm. (43-61 in.). Preferably, the section is less than 25.4 cm. (10 in.) wide. The top portion 12 is advantageously provided with an under turned or hemmed rear edge 24 and with clipped rear edge corners 26. In this manner, the chances of installers being cut by the rear edge 24 or corners 26 is reduced, and the chances of the rear edge 24 or corners 26 getting caught or causing damage as they are inserted under roof shingles 28 is reduced.

As further illustrated in FIGS. 1 and 2, the top portion 12 is preferably formed with a longitudinally extending, imperforate rear section 30 which extends forwardly from the hemmed rear edge 24 approximately 7.6-10.2 cm. (3-4 in.). Advantageously, the rear section 30 is bendable and, due to the relatively low profile of the present gutter cover 10 as explained in further detail below, the rear section 30 may be mounted on a fascia member 32 disposed behind the gutter 18, or under any of the first several horizontal rows 28 of shingles, as shown. In this manner, the present gutter cover 10 is believed to be easier to install and more versatile in terms of being suitable for use with half-round and box gutters, or mounted to the fascia 32 for slate, tile or flat roof installations.

As further illustrated in FIGS. 1 and 2, the top portion 12 of the present gutter cover 10 preferably includes a midsection 38. As illustrated, the midsection 38 is longitudinally coextensive with the gutter cover section 10 and has a width of approximately 7.6-10.2 cm. (3-4 in.) extending forwardly from a front boundary of the rear section 30. Preferably, a pair of longitudinally extending, spaced apart, upwardly projecting ridges 20 are formed on the midsection 38, and a plurality of generally equally spaced apart openings 22 extend through the midsection 38 on, in front of, behind and in between the ridges 20. The ridges 20 are intended to slow and dam rainwater flowing onto the gutter cover section 10 and to add strength to the top portion 12 of the gutter cover 10. The openings 22 drain the rainwater into the gutter 18 there below and are preferably within the range of 0.16-0.20 cm (0.063-0.078 in.) in diameter. It is believed that the drainage of rainwater into the gutter 18 is restricted by smaller diameter openings and that larger diameter openings tend to collect or trap debris on the top portion 12. The top portion 12 is also preferably formed with a longitudinally coextensive front section 40 disposed between the midsection 38 and the wall portion 13A, 13B. The front section 40 is preferably approximately 1.3-2.5 cm. (0.5-1.0 in.) in width, , imperforate, planar, and generally horizontally disposed.

Figure 3:
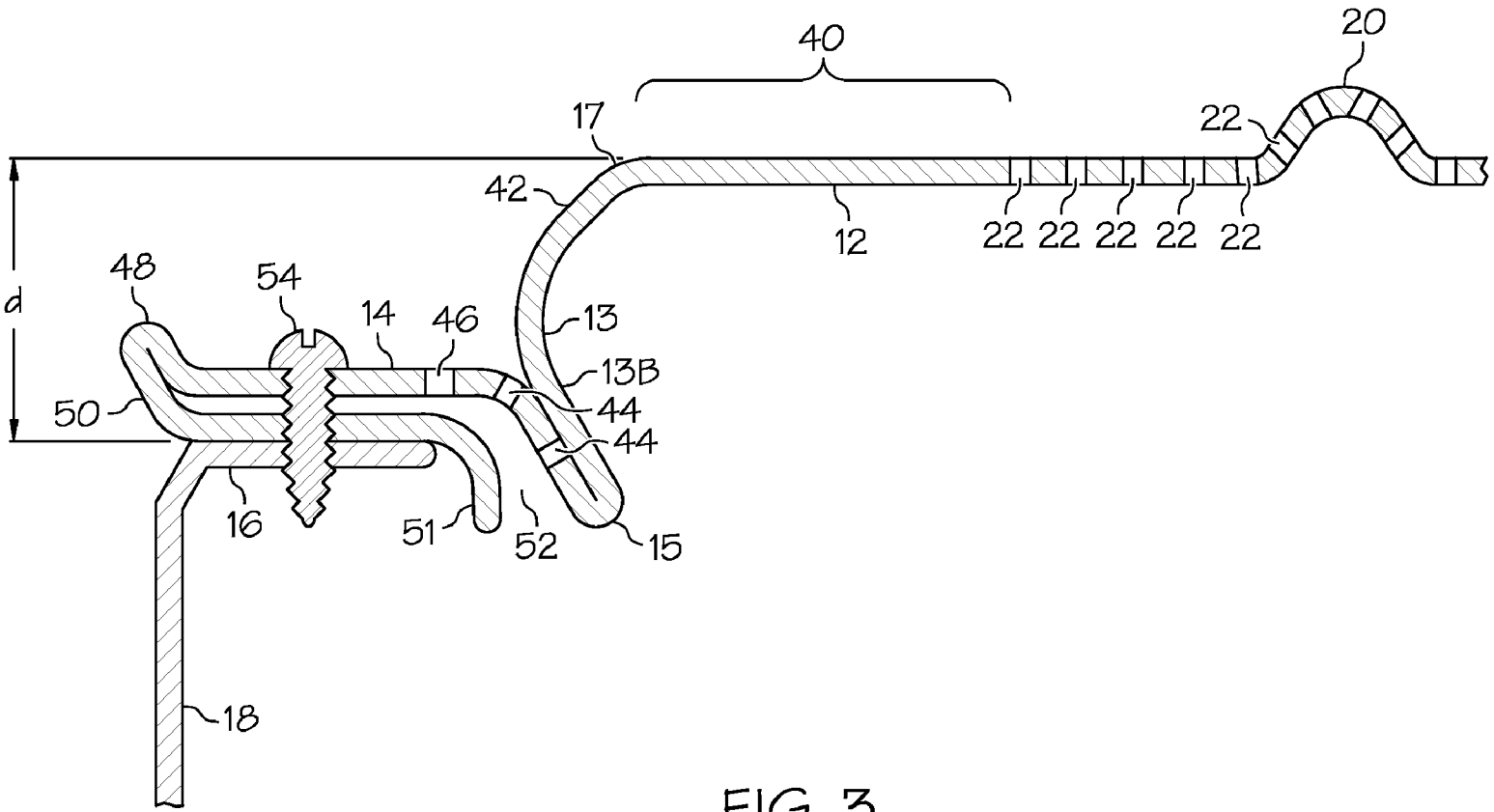
FIG. 3 is a further enlarged fragmentary sectional view of the area generally designated 3 in FIG. 2.

As illustrated in FIGS. 2 and 3, the front wall 13 preferably includes a curved nose or inclined ramp 42 extending forwardly and downwardly from the front section 40 of the top portion 12. A lower section 13B of the front wall 13 preferably includes a splashguard 15 extending downwardly and inwardly a distance within a range of 0.8-1.5 cm. (0.3-0.6 in.), and then upwardly and outwardly into the generally horizontal ledge 14. Advantageously, the splashguard 15 is provided with several ports 44 through which rainwater drains into the gutter 18, As illustrated in FIG. 3, the horizontal ledge 14 is preferably provided with a plurality of weep holes 46 and with an upturned lip 48 to keep rainwater from dripping off of the ledge. A return gutter lip-mounting surface 50 preferably extends rearwardly from a lower end of the ledge lip 48 a distance slightly greater than the width of the gutter lip 16 and terminates in a downwardly curved, gutter lip-engaging end flange 51. A space 52 is advantageously provided between the ledge 14 and the gutter lip-mounting surface 50 through which rainwater reaches the gutter 18. Preferably, the ledge 14 is secured to the gutter lip 16 by zip screws 54 or other fasteners. Additional cover sections (not shown) are installed in substantially the same manner as described above to completely cover the gutter 18.

As further illustrated in FIG. 3, it is preferable for the front wall 13 to be relatively short so that a vertical distance d from an upper end 17 of the front wall 13 to the generally horizontal ledge 14 is less than 2.54 cm. (1.0 in.), and preferably, approximately 1.27 cm. (0.5 in.). It is believed that by keeping the distance d relatively small, the versatility of the present gutter cover 10 is enhanced, both in terms of its adaptability to gutters of various shapes and sizes and in terms of its ability to be mounted at various heights and locations to accommodate the existing gutter structure. In addition, the low profile appearance created by keeping the distance d relatively small is believed to add aesthetic appeal to the present gutter cover section 10, once installed.

Figure 4:
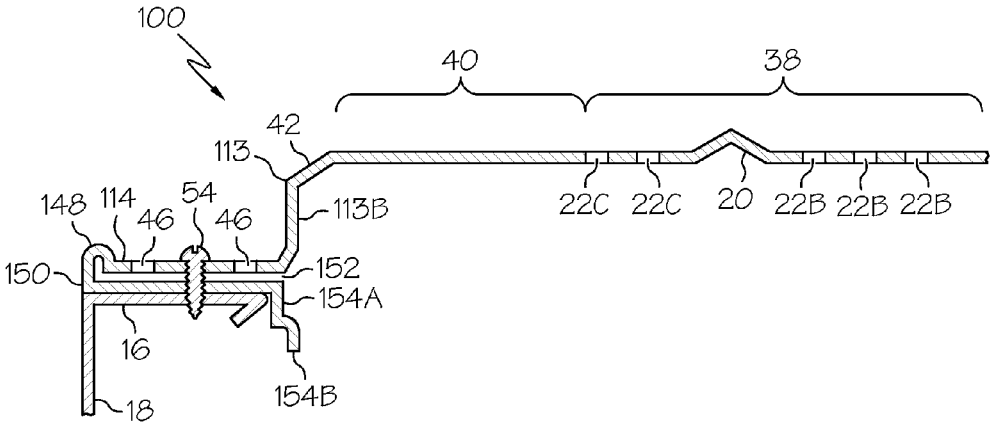
FIG. 4 is an enlarged fragmentary sectional view similar to FIG. 3 and illustrates a second embodiment of the present invention.

FIG. 4 illustrates a second embodiment, generally designated 100, of the present gutter cover. The top portion 12 of the present embodiment 100 is substantially the same as the top portion 12 of the first embodiment 10 illustrated in FIGS. 1-3, so the components of the top portions 12 of the first and second embodiments have been identified with the same reference numbers. The lower section 113B of the front wall, however, does not include a splashguard, but instead turns forwardly at approximately a right angle into the horizontal ledge 114. The ledge 114 is formed with several weep holes 146 and with a raised lip 148. A gutter lip-mounting return surface 150 extends rearwardly from a lower end of the ledge lip 148, and a space 152 is provided between the ported ledge 14 and the gutter lip-mounting surface 150. A free end of the mounting surface 150 is formed with a first gutter lip-engaging portion 154A projecting downwardly at approximately a right angle to the mounting surface 150, and with a second gutter-engaging portion 154B projecting downwardly and inwardly in a curve which is adapted to engage the lip of a half-round gutter (not shown).

Figure 5:
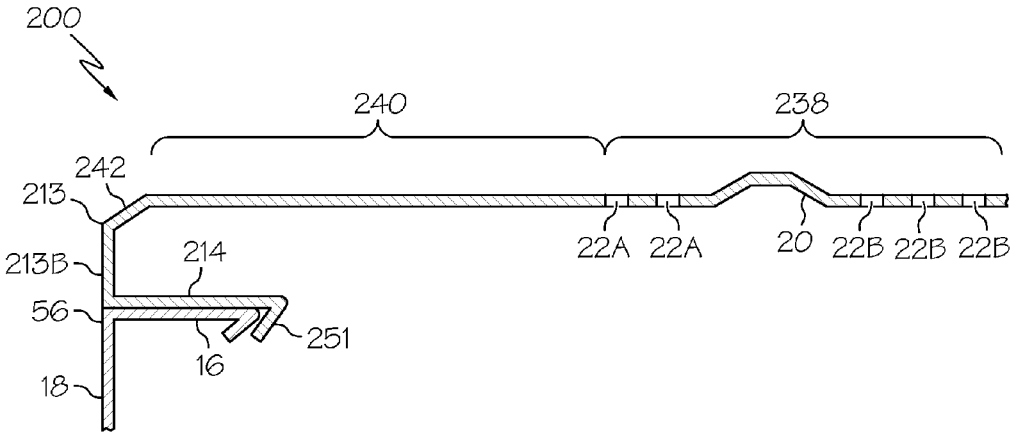
FIG. 5 is an enlarged, fragmentary sectional view similar to FIG, 4 and illustrates a third embodiment of the present invention.
Figure 6:
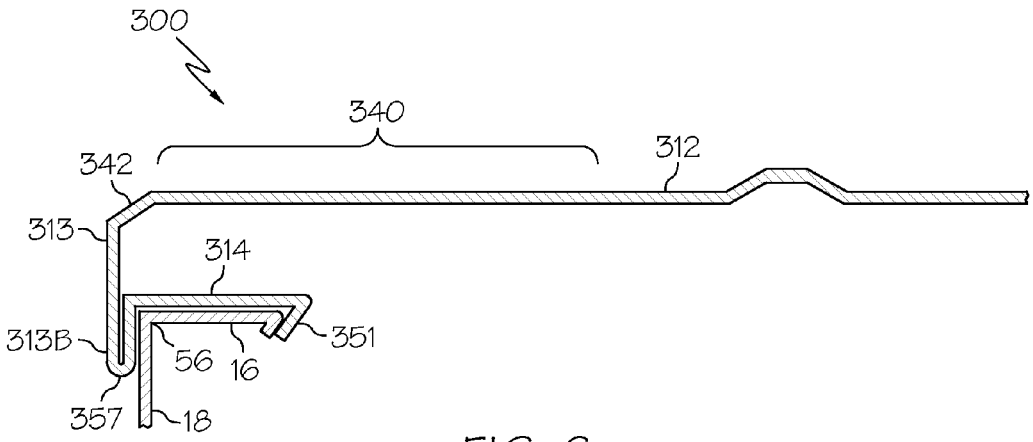
FIG. 6 is an enlarged, fragmentary sectional view similar to FIG. 5 and illustrates a fourth embodiment of the present invention.

FIG. 5 illustrates a third embodiment 200 of the present invention. As can be seen, the ridge 220 in the top section 212 preferably has a flat peak, and the front section 240 extends forwardly further than the front sections 40 of the first and second embodiments 10, 100. The front wall 213 includes a nose portion 242 that is preferably the same as the nose portions 42 of the first and second embodiments 10, 100. The front wall 213 is preferably vertically aligned with an upper front corner 56 of the gutter 18, and the lower section 213B turns rearwardly at approximately a right angle into the ledge 214. The horizontal ledge 214 extends rearwardly a distance slightly greater than the width if the gutter lip 16 and is preferably formed with a downwardly and forwardly curved end flange 251.

FIG, 6 illustrates a fourth embodiment 300 of the present invention. The front, generally horizontal section 340 of the top 312 extends forwardly slightly further than the front portion 240 of the previous embodiment 200 illustrated in FIG. 5. In this manner, the lower portion 313B of the front wall extends downwardly below and in front of the horizontal ledge 314, preferably by 0.25-0.75 inch. A return bend 357 connects the lower portion 313B of the front wall to the rearwardly extending ledge 314. A downwardly and forwardly curved end flange 351 is also provided. The return bend 357, the ledge 314 and the end flange 351 are preferably sized and positioned to be resiliently mounted on the gutter lip 16.

Figure 7:
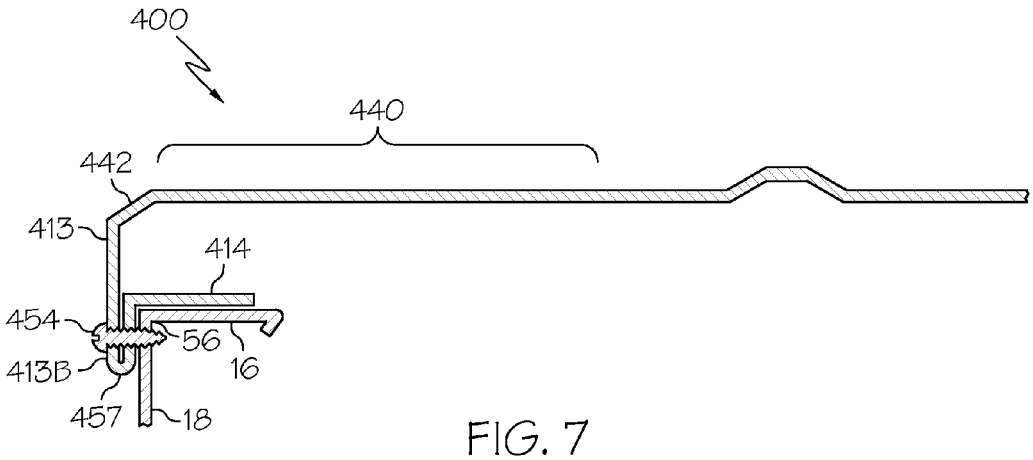
FIG. 7 is an enlarged, fragmentary sectional view similar to FIG. 6 and illustrates a fifth embodiment of the present invention.

FIG. 7 illustrates a fifth embodiment 400 of the present invention. The lower portion 313B of the front wall extends downwardly below and in front of the horizontal ledge 414, preferably by 0.25-0.50 inch. A return bend 457 connects the lower portion 413B to the rearwardly extending ledge 414. The ledge 414, however, extends rearwardly only partially over the gutter lip 16, and a zip screw 454 or other fastener secures the lower portion 413B of the front wall and the return bend 457 to the gutter 18.

While several embodiments of the present gutter cover section have been illustrated and described in substantial detail, the foregoing disclosures are not intended to limit the spirit of the invention or the scope of the following claims.

The invention claimed is:

1. A cover section for a roof gutter, said cover section being fashioned to extend longitudinally in overlying relation to a length of the gutter, said cover section comprising:

(i) a top portion extending forwardly from a rear edge of said cover section;

(ii) a front wall extending downwardly from the top portion;

(iii) a ledge extending generally horizontally from a lower section of the front wall;

(iv) at least one longitudinally extending ridge formed in the top portion; and (v) a plurality of apertures extending through the top portion, said plurality of apertures being sufficient to allow passage of draining rainwater into said gutter, such that said rainwater is drained into said gutter principally through said top portion; and wherein a vertical distance d between an upper end of said front wall and said generally horizontal ledge is equal to or less than about 1.0 inch.

2. The cover section according to claim 1, wherein said cover section is integrally and unitarily formed from a single sheet of aluminum alloy having a thickness within a range of 0.041-0.081 cm. (0.016-0.032 in.).

3. The cover section according to claim 1, wherein the top portion is provided with a hemmed rear edge.

4. The cover section according to claim 3, wherein the top portion is provided with a clipped rear edge corner at at least one end of the hemmed rear edge.

5. The cover section according to claim 1, wherein the top portion comprises a midsection, said midsection comprising a pair of relatively spaced apart, longitudinally extending ridges.

6. The cover section according to claim 1, wherein said cover section comprises at least two longitudinally extending ridges, and wherein the apertures are disposed at a location selected from at least one of: on, in front of, behind, and in between the at least two longitudinally extending ridges.

7. The cover section according to claim 1, wherein the front wall is formed with a splashguard extending below the generally horizontal ledge a distance within a range of about 0.2 to about 0.5 inches.

8. The cover section according to claim 7, wherein the splashguard is provided with a plurality of generally circular ports.

9. The cover section according to claim 8, wherein the horizontal ledge is provided with a plurality of generally circular ports adjacent to the splashguard.

10. The cover section according to claim 9, wherein the horizontal ledge is provided with a front lip extending generally upwardly a distance less than one-half of the horizontal extent of said ledge.

11. The cover section according to claim 1, wherein a gutter lip-mounting surface extends generally rearwardly from a front portion of the horizontal ledge, said lip-mounting surface being continuous with and generally vertically aligned with said ledge.

12. The cover section according to claim 11, wherein a space is provided between the horizontal ledge and the gutter lip-mounting surface.

13. The cover section according to claim 11, wherein a free end of the gutter lip-mounting surface is formed with a downwardly curved gutter-engaging flange.

14. The cover section according to claim 1, wherein the front wall is generally vertically aligned with an upper front corner of the gutter.

15. The cover section according to claim 14, wherein the horizontal ledge extends rearwardly from a lower end of the front wall.

16. The cover section according to claim 15, wherein the horizontal ledge is adapted to be mounted on the lip of the gutter and wherein a downwardly and forwardly curved gutter lip-engaging end flange is provided on the horizontal ledge.

17. The cover section according to claim 1, wherein the front wall extends downwardly below and in front of the horizontal ledge.

18. The cover section according to claim 1, wherein each of the plurality of apertures is approximately 0.16-0.20 cm (0.063-0.078 in.) in diameter.

* * * * *